US011056779B2

(12) United States Patent
Ziolkowski

(10) Patent No.: US 11,056,779 B2
(45) Date of Patent: Jul. 6, 2021

(54) SYNTACTIC FOAM RADOME STRUCTURE

(71) Applicant: CPI Radant Technologies Division, Inc., Stow, MA (US)

(72) Inventor: Fredric Paul Ziolkowski, South Grafton, MA (US)

(73) Assignee: CPI Radant Technologies Divisions Inc., Stow, MA (US)

( * ) Notice: Subject to any disclaimer, the term of this patent is extended or adjusted under 35 U.S.C. 154(b) by 66 days.

(21) Appl. No.: 16/696,366

(22) Filed: Nov. 26, 2019

(65) Prior Publication Data

US 2021/0175616 A1 Jun. 10, 2021

(51) Int. Cl.
*H01Q 1/42* (2006.01)

(52) U.S. Cl.
CPC ..... *H01Q 1/422* (2013.01)

(58) Field of Classification Search
CPC ..... H01Q 1/422
See application file for complete search history.

(56) References Cited

U.S. PATENT DOCUMENTS 5,486,399 A * 1/1996 Brydon ..... B64G 1/58 343/877
5,662,293 A * 9/1997 Hower ..... B64C 7/00 244/133
5,683,646 A * 11/1997 Reiling, Jr. ..... B29C 33/0011 264/225
6,107,976 A * 8/2000 Purinton ..... H01Q 1/42 343/872
7,420,523 B1 9/2008 Ziolkowski et al.
8,917,220 B2 12/2014 Ziolkowski et al.
9,099,782 B2 8/2015 Ziolkowski
2013/0002514 A1* 1/2013 Ziolkowski ..... H01Q 1/286 343/872
2013/0321236 A1* 12/2013 Ziolkowski ..... H01Q 1/424 343/872
2016/0172745 A1* 6/2016 Keen ..... H01Q 1/50 343/705
2016/0172748 A1* 6/2016 Keen ..... H01Q 1/422 343/872
2016/0233578 A1* 8/2016 Kume ..... B29C 70/34
2020/0212556 A1* 7/2020 Moore ..... B32B 27/08

* cited by examiner

*Primary Examiner* — Lam T Mai
(74) *Attorney, Agent, or Firm* — Iandiorio Teska & Coleman, LLP

(57) ABSTRACT

A radome wall structure includes one or more laminate plies, a first syntactic foam layer on one side of the one or more laminate plies, and a second syntactic foam layer on the other side of the one or more laminate plies. One or more laminate plies are between a third outer syntactic foam layer and the first syntactic foam layer and one or more laminate plies are between a fourth inner syntactic foam layer and the second syntactic foam layer. An interior matching layer is adhered to the fourth inner syntactic foam layer.

19 Claims, 6 Drawing Sheets

SYNTACTIC FOAM RADOME STRUCTURE

FIELD OF THE INVENTION

This invention relates to, in one preferred embodiment, an improved lightweight multiband radome structure for millimeter wave frequencies.

BACKGROUND OF THE INVENTION

Airborne satellite communication links are currently being developed for millimeter wave (K-Ka and Ku-K-Ka band) frequencies in order to achieve the broad bandwidths for high data rates. The K-Ka and Ku-K-Ka band frequencies require a radome wall design that differs radically from the thin laminate skin, low density core, sandwich design that has prevailed since World War II. For example, the thin-skin A-sandwich design for single band, centimeter wavelength airborne radomes has a typical thickness of about 0.3", an areal weight of about 0.5 pounds per square foot (PSF), and a transmission efficiency of about 95 percent, but very poor cross polarization discrimination XPD which is the ratio of the co-polar and cross-polar transmissions. Designs for multiband, millimeter wavelength K-Ka and Ku-K-Ka radomes require a nominal half-wave solid laminate core with outer, quarter wave matching layers; this achieves acceptable structural and electrical performance, including XPD, particularly for low profile shapes that incur high incidence angles. The thickness of these designs is about 0.25", but their areal weight increases to 1.5 to 2.5 PSF and the transmission efficiency decreases to 80 to 60 percent. The basic multi-layer design for millimeter wavelength K-Ka radomes has three layers; the addition of a fourth interior matching layer increases the minimum transmission efficiency of the Ku-K-Ka design from 60 percent to about 75 percent for the worst cases, and slightly increases the weight. The basic 3-layer, K-Ka B-sandwich has received a U.S. Patent, U.S. Pat. No. 7,420,523, B1, dated 2 Sep. 2008, and assigned to Radant Technologies, Inc. and a 4-layer, $B^+$ sandwich design for K-Ka and Ku-K-Ka bands is disclosed in a U.S. Pat. No. 8,917,220 by Radant Technologies, Inc. both of which are incorporated herein in their entirety by this reference. The light weight configuration that is described in the following summary for light weight radome designs has application to K-Ka and Ku-K-Ka band radome designs.

U.S. Pat. No. 9,099,782, also incorporated herein by this reference, discloses a foam core radome construction.

SUMMARY OF THE INVENTION

Large commercial airliners manufactured by Boeing and Airbus support low profile fuselage-mounted radomes for satellite communications that can be fairly large (e.g., 10 feet long) with minimal curvature for a low profile. For smaller aircraft, however, such as a Bombardier, Embraer, Gulfstream or Lear Jet desirous of Ka/Ku band transmissions, the radome is mounted on or made integral within the top of the vertical stabilizer of the aircraft. With the more extreme curvature of this shape, the physical and electrical thickness of multiband 3-layer B-sandwich and 4-layer B+ sandwich radomes causes phase distortion which degrades the performance of the radome. The radome weight also becomes an issue because of the smaller aircraft size and the vertical stabilizer location on the aircraft. A strategy to reduce the weight, the electrical thickness, and the phase distortion is to replace the relatively heavy, high dielectric, electrically thick half-wave laminate core by a thin-skin A-sandwich, light weight and electrically thinner core, so that it imposes less phase distortion for high curvature, vertical stabilizer radomes. Because this core becomes thin at millimeter wave frequencies, honeycomb and very low density polymer foams are difficult to cut to thickness and to process for radome manufacture. For example, the honeycomb cells in the light weight core can be spuriously filled with resin during the laminate cure process. Very low density foams that can be co-cured with 350° F., high performance laminates are brittle and difficult if not impossible to form to highly curved surfaces typical of vertical stabilizer radomes. These very low density, very low dielectric core materials also degrade the XPD.

In one aspect, a new radome design, in one example, replaces the very low density material in the light weight core with syntactic foam material (also called syntactic film). Although heavier, this replacement is much lighter than the solid laminate core so that it significantly reduces weight. The syntactic foam core also improves manufacturability and XPD relative to the very low density honeycomb and foam cores. The syntactic foam core design approaches the electrical performance achieved with the heavier, electrically thicker laminate core design.

The subject invention, however, in other embodiments, need not achieve all these objectives and the claims hereof should not be limited to structures or methods capable of achieving these objectives.

Featured is a radome wall structure comprising one or more central laminate plies, a first syntactic foam layer on one side of the one or more central laminate plies, and a second syntactic foam layer on the other side of the one or more central laminate plies. There is a third outer syntactic foam layer, one or more laminate plies between the third outer syntactic foam layer and the first syntactic foam layer, a fourth inner syntactic foam layer, and one or more laminate plies between the fourth inner syntactic foam layer and the second syntactic foam layer. An interior matching layer is on the fourth inner syntactic foam layer. There is an outer syntactic foam layer on either side of the laminate plies. An interior matching layer of low density polymer foam and adhesive may be added to improve electrical performance. Certain applications may replace the central laminate and adjacent syntactic foam layers with a single foam layer.

The radome wall structure may further include a paint layer on the third outer syntactic foam layer. Preferably, the syntactic foam layers include a resin mixed with gas filled structures. Preferably, each laminate ply includes a glass or quartz fabric impregnated with a resin. In one example, the interior matching layer is made of low density polymer foam and is adhered to the fourth inner syntactic foam layer.

Also featured is a radome wall structure comprising a sandwich, multi-layer core including one or more central laminate plies sandwiched between first and second syntactic foam layers, an outer laminate layer including one or more plies on the first syntactic-foam layer, and a second outer laminate layer including one or more plies on the second syntactic foam layer. An outer syntactic foam matching layer is adjacent to the outer laminate of the core, an inner syntactic foam matching layer is adjacent the opposite side of the core, and an interior matching layer of lighter weight foam is adjacent the inner syntactic foam matching layer.

In one example, there is one core ply sandwiched between the first and second syntactic film layers, the laminate layer on the first syntactic foam layer includes two plies, and the laminate layer on the second syntactic foam layer includes two plies. Preferably, the core has a thickness of W wavelength, the outer syntactic matching layers have a thickness of ¼ wavelength, and the internal matching layer has a thickness of W wavelength. The total thickness slightly exceeds about 1 free-space wavelength.

Also featured is a radome wall structure comprising a ½ wavelength thickness core including layers of syntactic foam and laminate materials, inner and outer ¼ wavelength thickness syntactic foam matching layers, and a ¼ wavelength thickness interior matching layer.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1A:
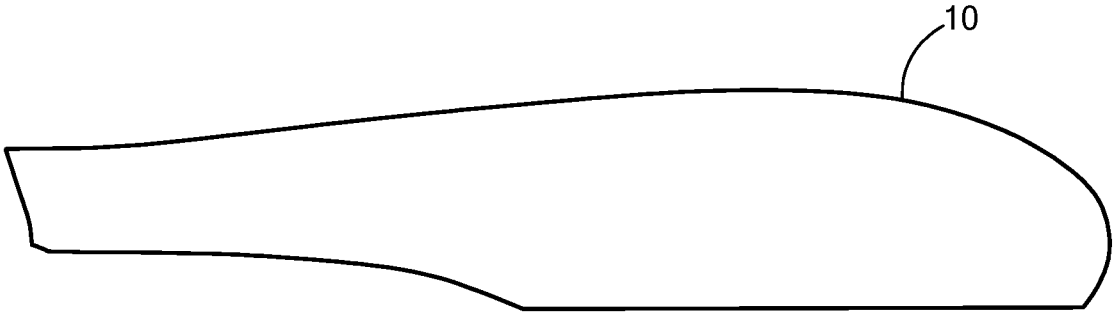
FIG. 1A is a side view of an example of a new radome.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

Figure 1B:
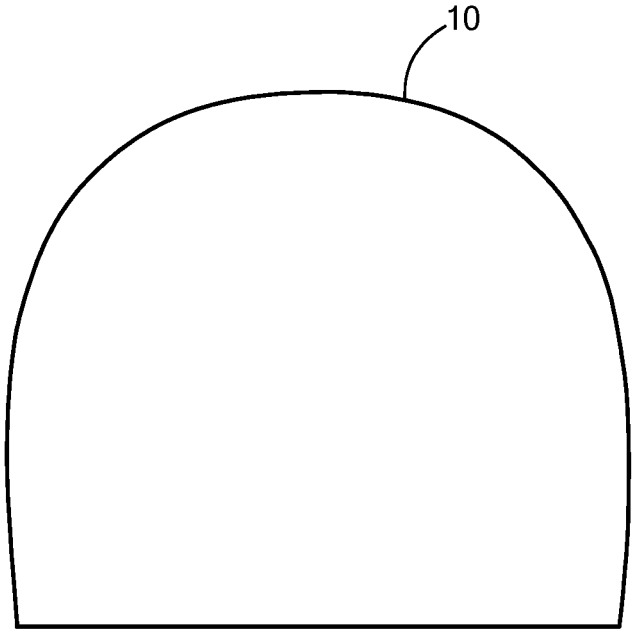
FIG. 1B is a schematic front view of the radome of FIG. 1A.
Figure 1C:
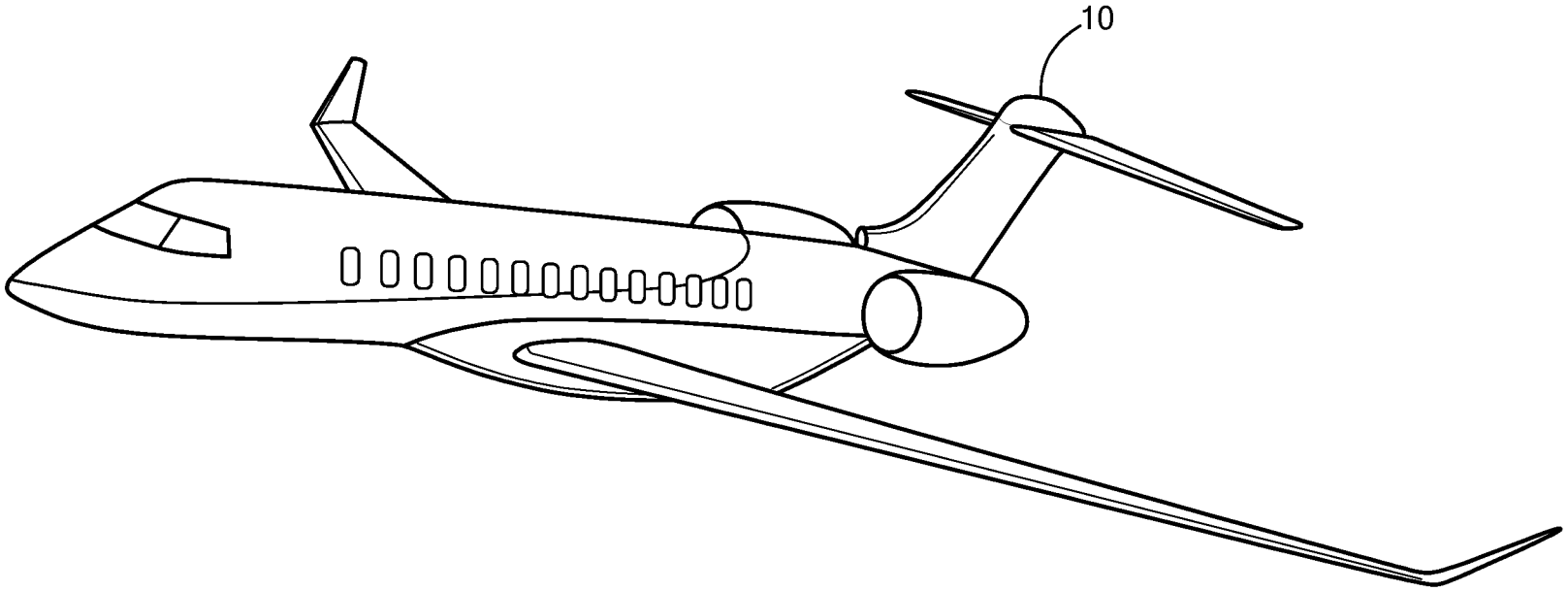
FIG. 1C is a schematic view showing the radome of FIGS. 1A and 1B mounted to or integral with the vertical stabilizer of a smaller jet aircraft.

FIG. 1A shows an example of a new radome 10 mounted to or integrated into the top of an aircraft vertical stabilizer. FIG. 1B shows how the front of the radome now has a more severe curvature. Still, the radome construction disclosed herein in the preferred embodiment, exhibits excellent transmission properties and lower phase distortion. Furthermore, the radome is easier to manufacture and it can used with or added to or incorporated into the vertical stabilizer of a small jet as shown in FIG. 1C.

Figure 2:
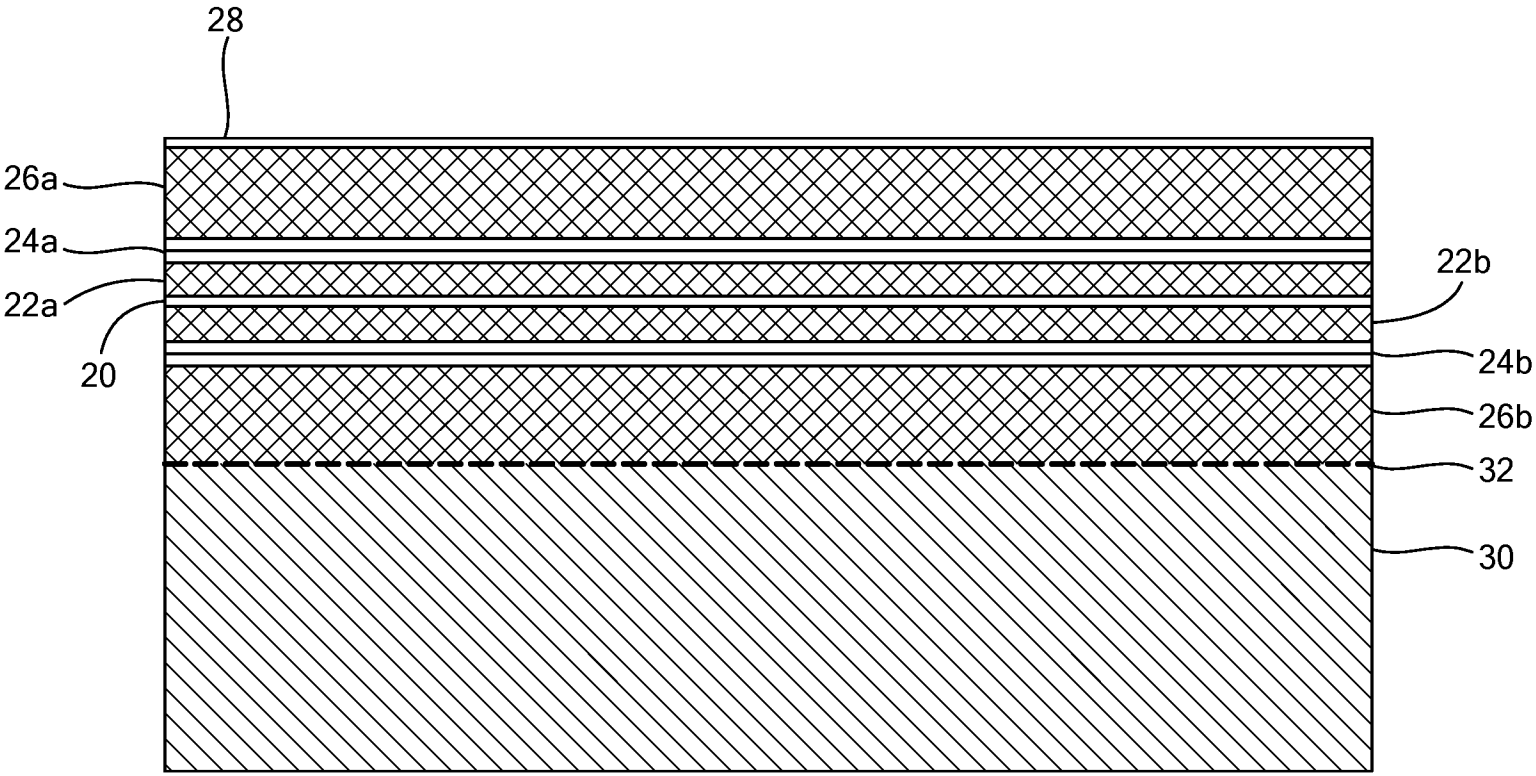
FIG. 2 is a cross-sectional view of a new radome wall structure.

FIG. 2 shows an example of a radome wall with a K wavelength core including one or more laminate plies 20 sandwiched between syntactic foam layers 22*a* and 22*b* themselves sandwiched between one or more laminate plies 24*a* and 24*b*. This core structure is then sandwiched between ¼ wavelength outer matching layer 26*a* and ¼ wavelength inner matching layer 26*b* (made of, for example, syntactic foam). Layer 28 is an outer paint layer and layer 30 is an interior ¼ wavelength matching layer (made of, for example, polyethylene foam) adhered to matching layer 26*b* via adhesive 32.

In general, the syntactic foam layers (for example, an epoxy resin or cyanate ester thermoset resin including gas (e.g., air) filled structures (e.g., micro-bubbles made of hollow glass spheres) are provided for improved electrical properties and the laminate plies (e.g., quartz or e-glass fabric impregnated with a thermoset resin (e.g., epoxy or cyanate)) provide the required strength. See also U.S. Pat. No. 9,099,782 incorporated herein by this reference.

The syntactic foam layers exhibit acceptable strength, have good dielectric properties (e.g., a dielectric constant of 1.7 to 2.2) suitable for matching the higher dielectric laminate, and can be easily processed (e.g., molded). The laminate layers add strength but have a high dielectric constant that impedes transmission. Laminate layer 20 is kept thin due to the higher frequencies used in the Ka-Ku bands. The laminate layers are also easily processed (e.g., molded).

In one particular example, the radome dielectric wall was constructed as follows:

| Layer | Piles | Thickness (inches) | Material |
|---|---|---|---|
| Paint 28 | — | 0.0040 | Various |
| Matching layers 26a-26b | — | 0.0850 | Syntactic foam |
| Strengthening Layers 24a-24b | 2 | 0.0200 | Laminate |
| 22a-22b | — | 0.0320 | Syntactic foam |
| Middle Layer 20 | 1 | 0.0100 | Laminate |
| Internal matching layer 30 | | 0.2830 | Polyethylene foam |

Preferably, the B– stage laminate layers and the syntactic foam layers am heated and molded into a desired shape (see FIGS. 1A-1B) to cure the resin(s) used and the interior matching layer 30 (e.g., having a dielectric constant of 1.1 to 1.4) is then added to the inside wall of the radome using adhesive 32. Then, the paint 28 is applied to the outside of the radome. The interior of the radome defines an open space for the antenna(s) protected by the radome.

Figure 3:
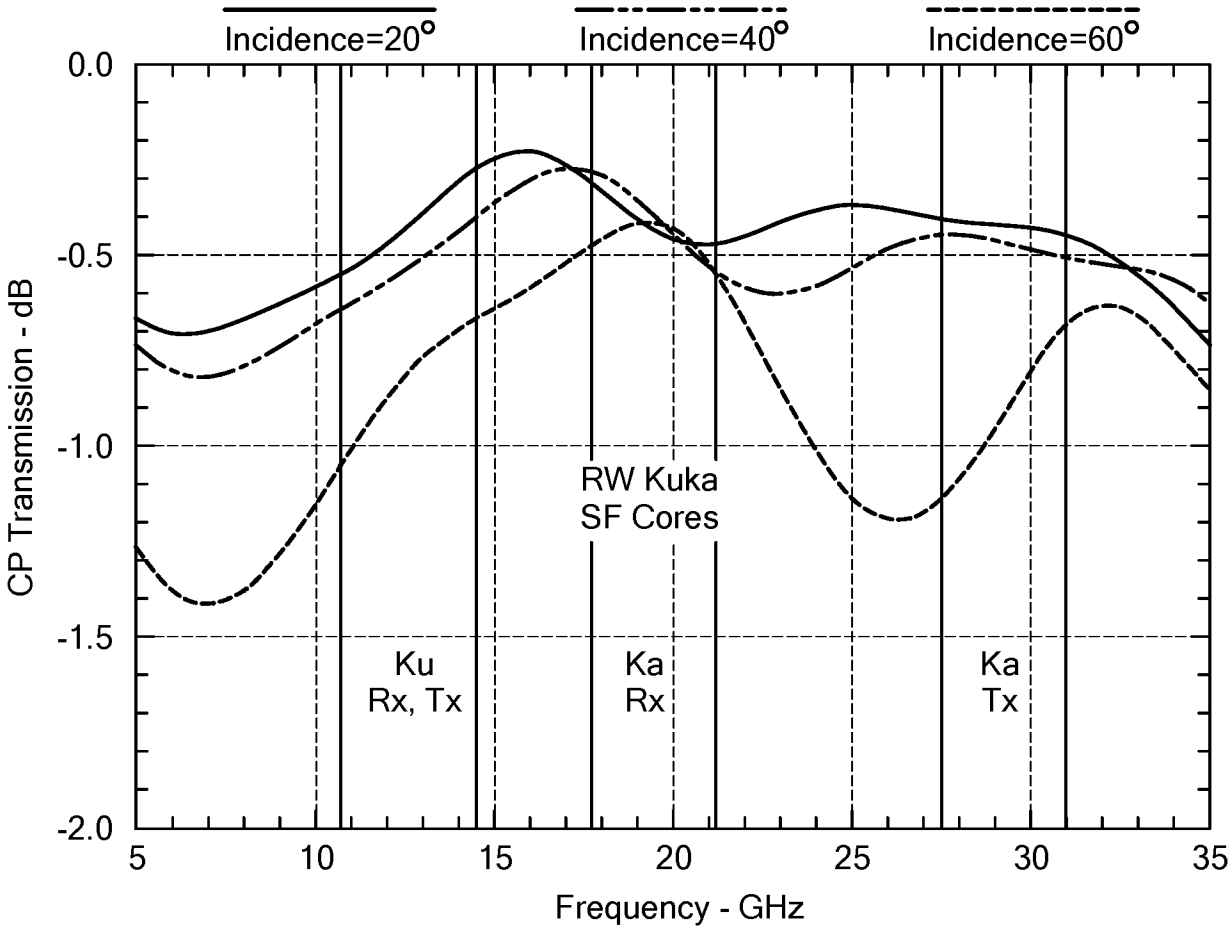
FIG. 3 is a graph comparing transmission properties for various frequency bands of the radome with a syntactic foam core as described herein.

FIG. 3 shows the improved transmission properties of such a radome structure with good performance at the Ku and Ka receive and transmit frequency bands. The two solid lines bound the range of incidence angles from 20° to 40° which represent over 90 percent of the field of view (FOV) of a tail mount radome. The dotted line represents the upper limit 60° incidence angle that models the remaining FOV. The model prediction is about −0.5 dB (~90%) transmission over 90 percent of the FOV for the new radome construction and transmission no worse than −1.15 dB (~75%)transmission over the remaining FOV.

Figure 4:
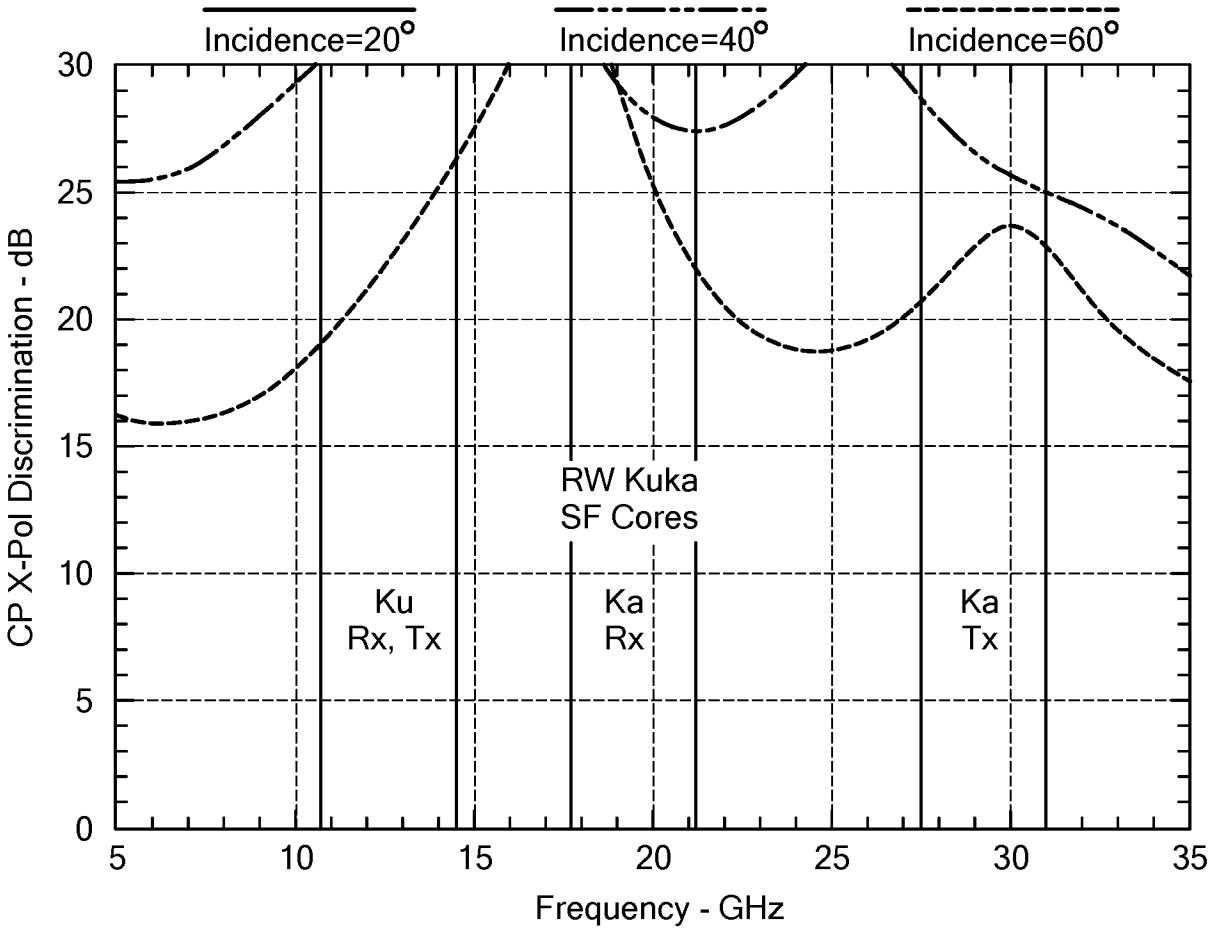
FIG. 4 is a graph comparing the cross polarization properties over various frequency bands of the radome with a syntactic foam core as described herein.
Figure 5:
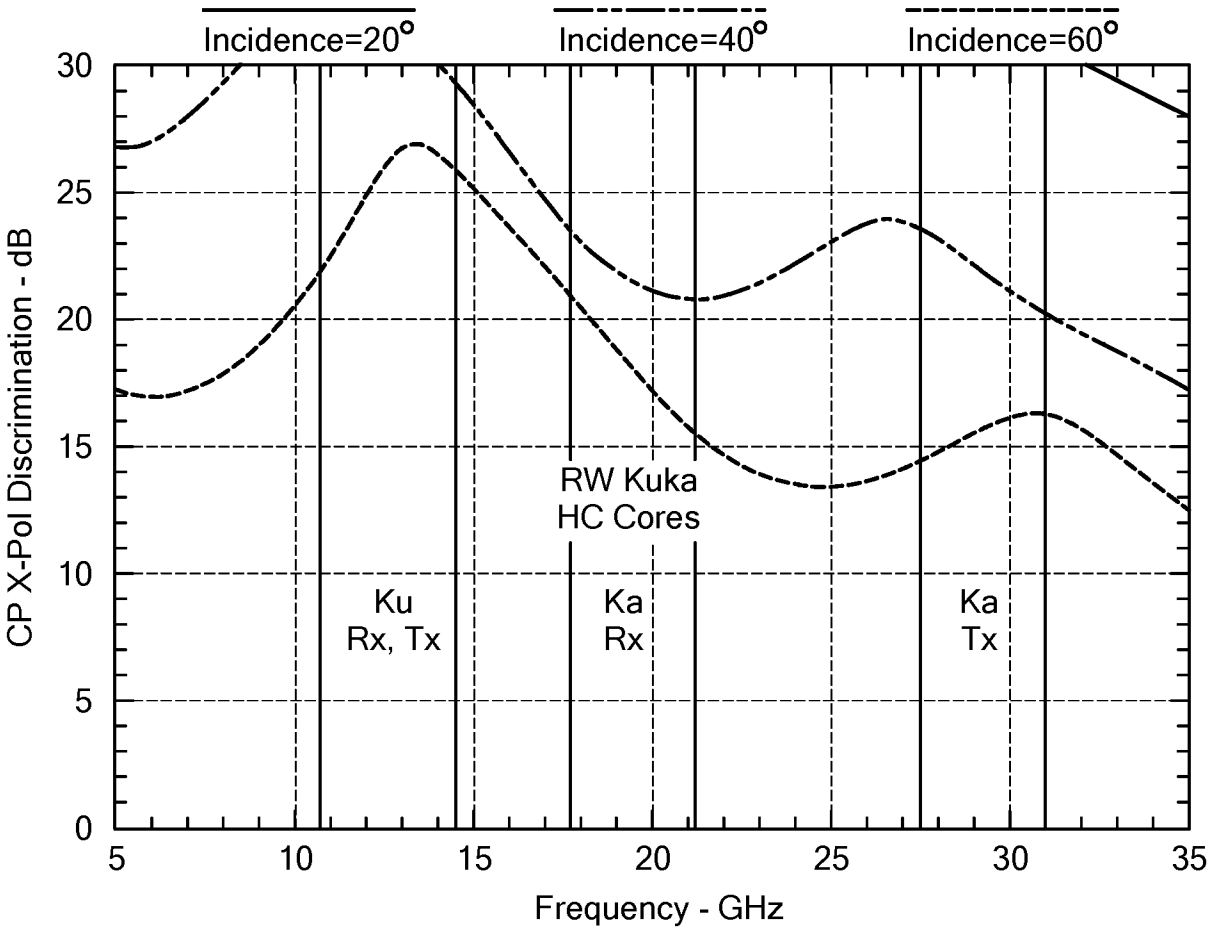
FIG. 5 is a graph comparing the cross polarization properties over various frequency bands of a radome with a honeycomb or low density foam core.

FIG. 4 shows the cross polarization discrimination performance for the new radome construction with a syntactic foam core to be at least 25 dB over 90 percent of the FOV and about 20 dB over the remaining FOV. By comparison FIG. 5 shows a poorer XPD performance when honeycomb or low density foam is present in the light weight core. For the Ka Tx band, the XPD may become as low as 20 dB over 90% of the FOV and 15 dB over 7% of the FOV.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant cannot be expected to describe certain insubstantial substitutes for any claim element amended.

Other embodiments will occur to those skilled in the art and are within the following claims.

What is claimed is:

1. A radome wall structure comprising:

one or more laminate plies;

a first syntactic foam layer on one side of the one or more laminate plies;

a second syntactic foam layer on the other side of the one or more laminate plies;

a third outer syntactic foam layer;

one or more laminate plies between the third outer syntactic foam layer and the first syntactic foam layer;

a fourth inner syntactic foam layer;

one or more laminate plies between the fourth inner syntactic foam layer and the second syntactic foam layer; and an interior matching layer on the fourth inner syntactic foam layer.

2. The radome wall structure of claim 1 further including a paint layer on the third outer syntactic foam layer.

3. The radome wall structure of claim 1 in which the syntactic foam layers include a resin mixed with gas filled structures.

4. The radome wall structure of claim 1 in which each laminate ply includes a glass or quartz fabric impregnated with a resin.

5. The radome wall structure of claim 1 in which the interior matching layer is made of foam and is adhered to the fourth inner syntactic foam layer.

6. A radome wall structure comprising:

a core including:

one or more laminate plies sandwiched between first and second syntactic foam layers, a laminate layer including one or more plies on the first syntactic foam layer, and a laminate layer including one or more plies on the second syntactic foam layer;

an outer syntactic foam matching layer adjacent one side of the core;

an inner syntactic foam matching layer adjacent the opposite side of the core; and an interior matching layer adjacent the inner syntactic foam matching layer.

7. The radome wall structure of claim 6 further including a paint layer on the outer syntactic foam matching layer.

8. The radome wall structure of claim 6 in which the syntactic foam layers include a resin mixed with gas filled structures.

9. The radome wall structure of claim 6 in which each laminate ply is glass or quartz fabric impregnated with a resin.

10. The radome wall structure of claim 6 in which the interior matching layer is made of foam.

11. The radome wall structure of claim 6 in which there is one ply sandwiched between the first and second syntactic foam layers.

12. The radome wall structure of claim 6 in which the laminate layer on the first syntactic foam layer includes two plies.

13. The radome wall structure of claim 6 in which the laminate layer on the second syntactic foam layer includes two plies.

14. The radome wall structure of claim 6 in which the core has a thickness of ½ wavelength, the syntactic foam matching layers have a thickness of ¼ wavelength, and the internal matching layer has a thickness of ¼ wavelength.

15. A radome wall structure comprising:

a ½ wavelength thickness core including layers of syntactic foam and laminate materials;

inner and outer ¼ wavelength thickness syntactic foam matching layers; and a ¼ wavelength thickness interior matching layer.

16. The radome wall structure of claim 15 further including a paint layer on the outer syntactic foam layer.

17. The radome wall structure of claim 15 in which the syntactic foam layers have a dielectric constant 1.7 to 2.2 and include a resin mixed with gas filled structures.

18. The radome wall structure of claim 15 in which each laminate ply is glass or quartz fabric impregnated with a resin.

19. The radome wall structure of claim 15 in which the interior matching layer is made of foam with a dielectric constant 1.1 to 1.4.

* * * * *